US005670940A

United States Patent [19]

Holcomb et al.

[11] Patent Number: 5,670,940

[45] Date of Patent: Sep. 23, 1997

[54] ELECTRONIC LOCK SYSTEM WITH OCCUPANCY BLOCK

[75] Inventors: Glen Holcomb, N. Richland Hills; William Reed, Arlington, both of Tex.

[73] Assignee: TrioVing a.s. Norway

[21] Appl. No.: 634,884

[22] Filed: Apr. 19, 1996

[51] Int. Cl.[6] ..... E05B 45/06

[52] U.S. Cl. ..... 340/543; 340/542; 340/540; 340/522; 340/296; 340/825.31; 70/431; 70/262; 70/263

[58] Field of Search ..... 340/296, 540, 340/541, 542, 543, 573, 325.32, 325.3, 325.31, 522; 70/431, 262, 263

[56] References Cited

U.S. PATENT DOCUMENTS

| | | | |
|---|---|---|---|
| 3,877,266 | 4/1975 | McLaughlin | 70/280 |
| 4,283,710 | 8/1981 | Genest et al. | 340/506 |
| 4,534,194 | 8/1985 | Aydin | 70/278 |
| 4,578,970 | 4/1986 | Youngblood et al. | 70/428 |
| 5,309,146 | 5/1994 | Kenet | 340/540 |
| 5,550,529 | 8/1996 | Burge | 340/296 |
| 5,591,950 | 1/1997 | Imedio-Ocana | 235/382.5 |

OTHER PUBLICATIONS

North American Technologies, Inc. brochure —SENSORSTAT Occupancy Sensing HVAC Controller.

North American Technologies, Inc. brochure—innPULSE.

Guest Room Management and Information System—Oct. 1993.

Teledex brochure—Comfort Central Guest Room Climate Control System.

NRG Management Systems, Inc. brochure —In-Room Information System—NRG Management Systems.

Alerton Technologies, Inc. brochure—Energy Management & Controls for Hotels.

*Primary Examiner*—Jeffery Hofsass
*Assistant Examiner*—Benjamin C. Lee
*Attorney, Agent, or Firm*—Bierman, Muserlian and Lucas

[57] ABSTRACT

The electric lock system operates to block access to the room when a guest key has been used and the guest is detected as being present in the room. The lock blocks access to hotel staff and provides the guest greater privacy in the room. The lock system employs an electronic lock in combination with a motion detector for detecting the presence of the guest in the room.

8 Claims, 5 Drawing Sheets

ELECTRONIC LOCK SYSTEM WITH OCCUPANCY BLOCK

BACKGROUND OF THE INVENTION

1. Field of the Invention

The present invention relates to electronic locks and, more specifically, to an electronic lock system used in hotels and the like where the lock is programmable to accept a plurality of key codes at the same time.

2. Prior Art

Electronic lock systems are commonly employed in hotels, motels, cruise ships and ferries where a room is rented to a guest for a short period of time and there is a need for a high level of security. The electronic lock system, in essence, provides each new guest with a new key and rekeys the lock for each new key used in the lock. Typically, an electronic lock system comprises a key generating station which is located at the check-in counter or front desk of the hotel and an electronic lock which is mounted in a door of a room and provides access to the room. The lock is opened by a key having magnetic data (key code) thereon. Typically, the key is in the form of a card and the magnetic data is encoded onto the key by the key generating station when it is assigned to the guest at the front desk. The lock has a means to read the magnetic data on the key and a microcontroller to compare the key code with an access code. The access code is either generated by the microcontroller through an algorithm or is stored in the memory of the microcontroller. If there is a match between the access code and the key code, then the lock opens and allows access to the room.

In order to insure that the key code and the access code match, the key generating station is either hard wired to the electronic lock so that it can communicate the new key code to the electronic lock; or the key generating station and the microcontroller use the same algorithm to calculate the codes; or the key generating station and the microcontroller store the same codes in their memories.

There are a number of ways that the lock system invalidates a guest key. For instance, the mere use of a new guest key with a new guest key code causes the previously used guest key code to be invalidated. In other cases, the key code includes a start time and an end time or a time period, e.g. a number of hours, during which the guest key code is valid. The use of a time period invalidates the guest key code at the end of the time period, without the need for a new guest key to be inserted in the lock. The use of time allows greater control by management of the access to the room by the guests.

Because of the increased security of the electronic lock, most hotels and the like have converted from the conventional metal key locks to electronic locks.

As with all hotel rooms, there is a need to allow access to the room by hotel staff, such as housekeeping and the like, during the time that a guest is renting the room. Thus, most electronic locks have a hierarchical system which allows access to the room by a plurality of keys, each key being held by different individuals, for example guests, housekeeping, maintenance personnel, and other hotel staff who perform day-to-day operations in the room.

If the guest is in the room, the lock can be opened by hotel staff unless the guest throws the deadbolt or other block mechanism. Since most guests forget to block access to the room by hotel staff when they are in the room, the privacy of the room is reduced and embarrassing situations can arise for the guest when hotel staff enters the room.

SUMMARY OF THE INVENTION

The present invention provides an electronic lock system in which the electronic lock automatically blocks access to the room by hotel staff when a guest is in the room. The system is automatic in that it detects when the guest is in the room and automatically blocks access to the room by hotel staff without the need for the guest to throw the deadbolt. The electronic lock system of the present invention employs a door switch and motion detector in conjunction with the electronic lock such that when the motion detector detects the presence of a guest in the room, the lock blocks access to the room by a person with a key that is not a guest key.

The blocking function of the lock is initiated or turned on each time a guest key card is inserted into the lock and the guest enters the room. The blocking function is turned off when the door switch changes state and no motion is detected in the room.

Broadly, the present invention relates to an electronic lock system having an electronic lock mounted in a door to allow access to a room wherein said lock can be opened by more than one key; and a key with a key code thereon; said lock having a means for reading said key code when said key is inserted into said electronic lock, a means for storing an access code, a means for comparing said key code with said access code such that if said key code matches said access code, said lock opens to allow access to said room, the improvement comprising:

(a) a guest key with a guest key code thereon for use by a guest, said means for storing an access code having a guest access code stored therein which matches said guest key code to allow access by said guest to said room;

(b) a staff key with a staff key code thereon for use by staff, said means for storing an access code having a staff access code stored therein which matches said staff key code to allow access by said staff to said room;

(c) a means for detecting when a person is in said room; and (d) a means for blocking opening of said lock by said staff key when said guest key has been used succeeded by said means for detecting having detected a person in said room.

It will be understood that there can be multiple staff keys, e.g. maintenance, housekeeping, and other staff personnel. It should also be understood that there can be multiple guest keys which will not be blocked from access to the room even though the motion detector detects the presence of a person in the room. Such other guest keys are issued to spouses, children or other guests who are sharing the room.

The means for detecting when a person is in the room is a detector mounted on the wall or contained in the lock, and a door switch mounted to the door frame or contained in the lock. The detector is preferably a conventional motion detector. The door switch is preferably a pressure switch which changes states every time the door is either opened or closed. Where the detector and/or door switch are not part of the lock, they must have a means to communicate with the lock and the lock must have a means to communicate with the detector and/or door switch. The means to communicate can be either wired or wireless. Preferably, both the detector and the door switch are part of the lock and communicate directly with the microcontroller of the lock.

The means for blocking is a function of the microcontroller which controls the operation of the lock. Typically, the microcontroller is housed in said electronic lock.

The means for blocking blocks access to the room by a staff key whenever the following two events occur in succession: (1) a guest key is used; and (2) the means for detecting detects a person in the room. More specifically, access to the room is blocked by the lock whenever the following three events occur in succession: (1) a guest key card is used to open the lock; (2) the door switch changes state, i.e. the door is opened and closed; and (3) the detector detects the presence of a person in the room. The succession of these events is fairly close to one another and is not interrupted by another event.

Naturally, the block must automatically turn off in order to be practical. Whenever the means for detecting a person in the room does not detect a person in the room, the block is turned off. Specifically, the block is turned off whenever the following two events occur in succession: (1) the door switch changes state; and (2) the detector fails to detect the presence of a person in the room.

In a preferred embodiment, the electronic lock system of the present invention blocks access to all hotel staff keys except security personnel. In this preferred embodiment, the electronic lock system of the present invention employs a security override which allows access to the room by a security key even though the motion detector detects the presence of a person in the room. In this preferred embodiment, the electronic lock system of the present invention blocks access to the room by hotel staff keys when the motion detector detects the presence of a person in the room, but not to persons with either a guest key or a security key.

In this preferred embodiment, a security key with a security key code thereon for use by security personnel cannot be blocked by the lock. The means for storing has a security access code that matches said security key code and allows access by said security personnel to said room. The means for blocking does not prevent opening of said lock by said security key.

DETAILED DESCRIPTION

Figure 1:
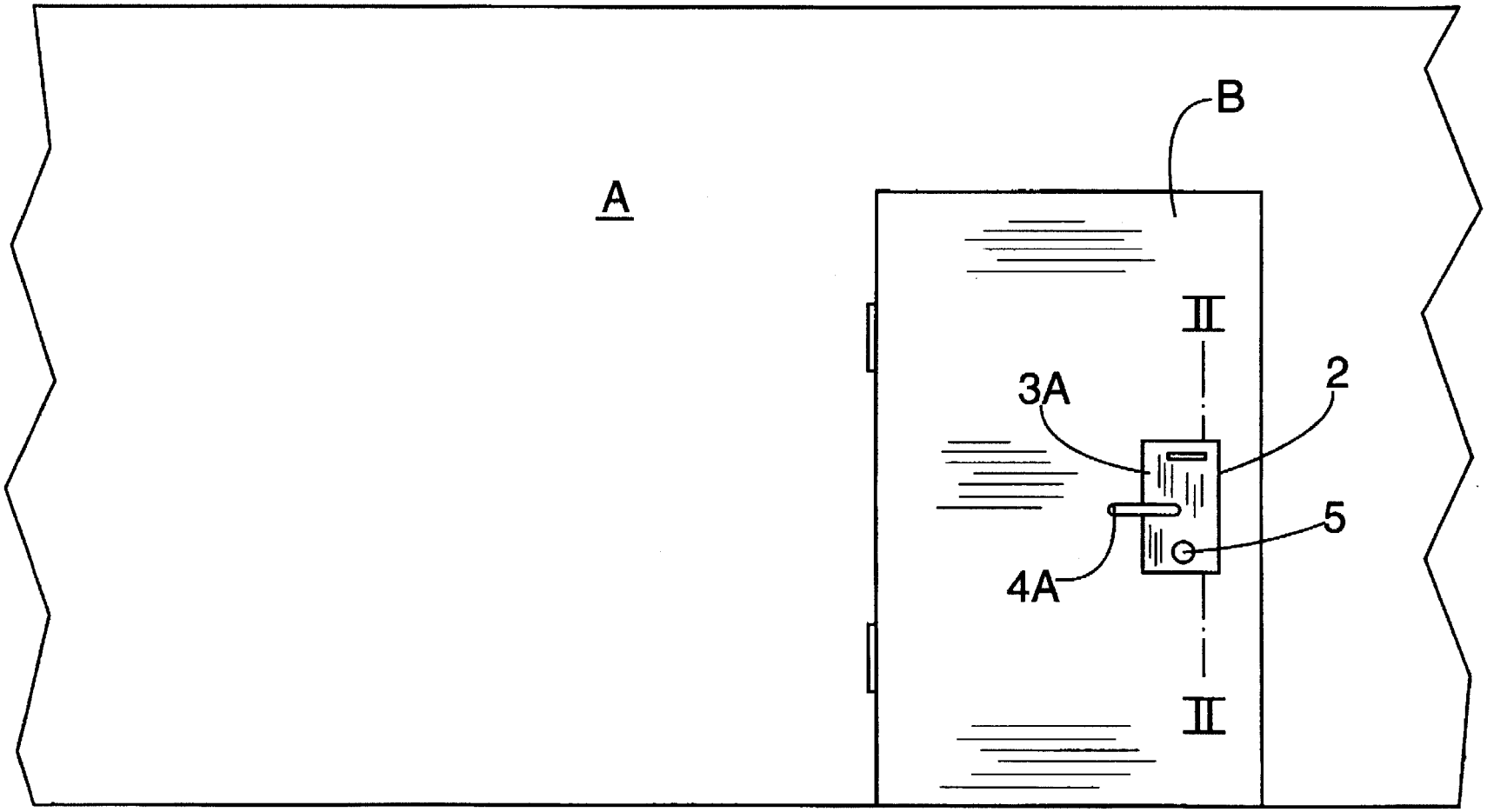
FIG. 1 shows schematically a vertical section of an exterior wall of a room wherein the door to the room is provided with a lock according to the present invention.
Figure 2:
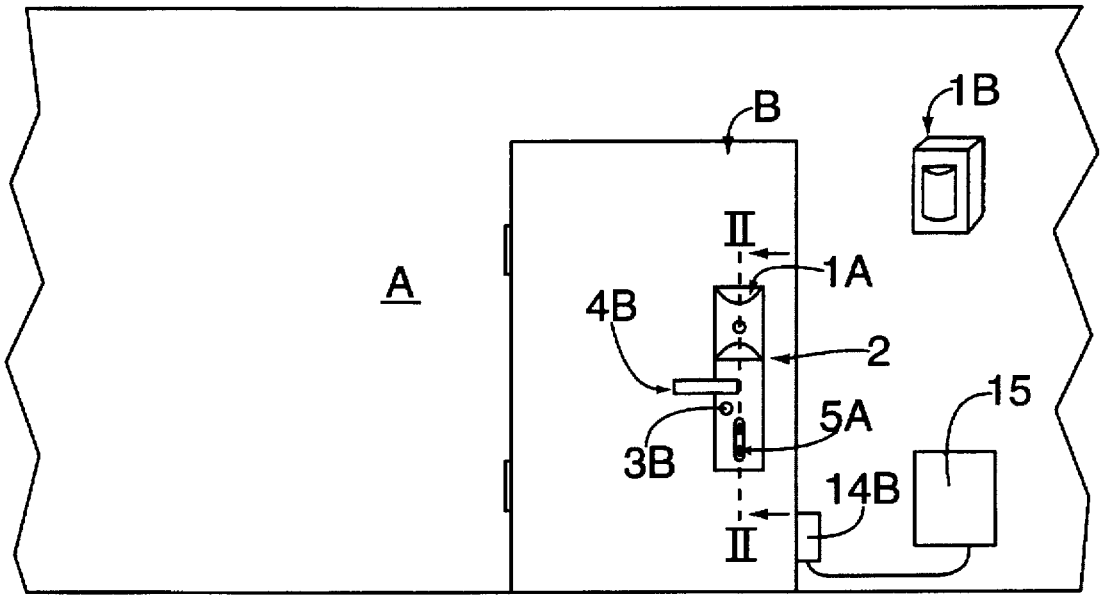
FIG. 2 shows schematically a vertical section of an interior wall of a room wherein the door is provided with a lock according to the present invention.

FIG. 1 shows schematically a vertical elevation of the exterior side of wall A of a room having door B therein. In wall A door B with lock 2 is mounted therein. Door B is provided with lock 2 according to the present invention. Lock 2 comprises exterior escutcheon 3A, exterior door handle 4A and preferably a conventional cylinder lock 5. FIG. 2 shows schematically a vertical elevation of the interior side of wall A of the room with door B therein. In accordance with a preferred embodiment, detector 1A is part of lock 2 and positioned under interior escutcheon 3B. The portion of interior escutcheon 3B that covers detector 1A is made of a material that allows the detector to view the room. Alternatively, instead of detector 1A being a component of the lock, detector 1B is mounted on the interior side of wall A.

It is preferred that detector 1A or 1B be able to view the whole room. In certain room configurations, suites, or multi-room areas, it may be necessary or desirable to use more than one detector to detect the presence of a person in the room.

FIG. 2 also illustrates interior door handle 4B, and dead-bolt lever 5A which is intended to be used when the guest is in the room. Lock 2 is also equipped with an electronic motor lock control unit which is housed in lock case 6, see FIG. 3.

Figure 3:
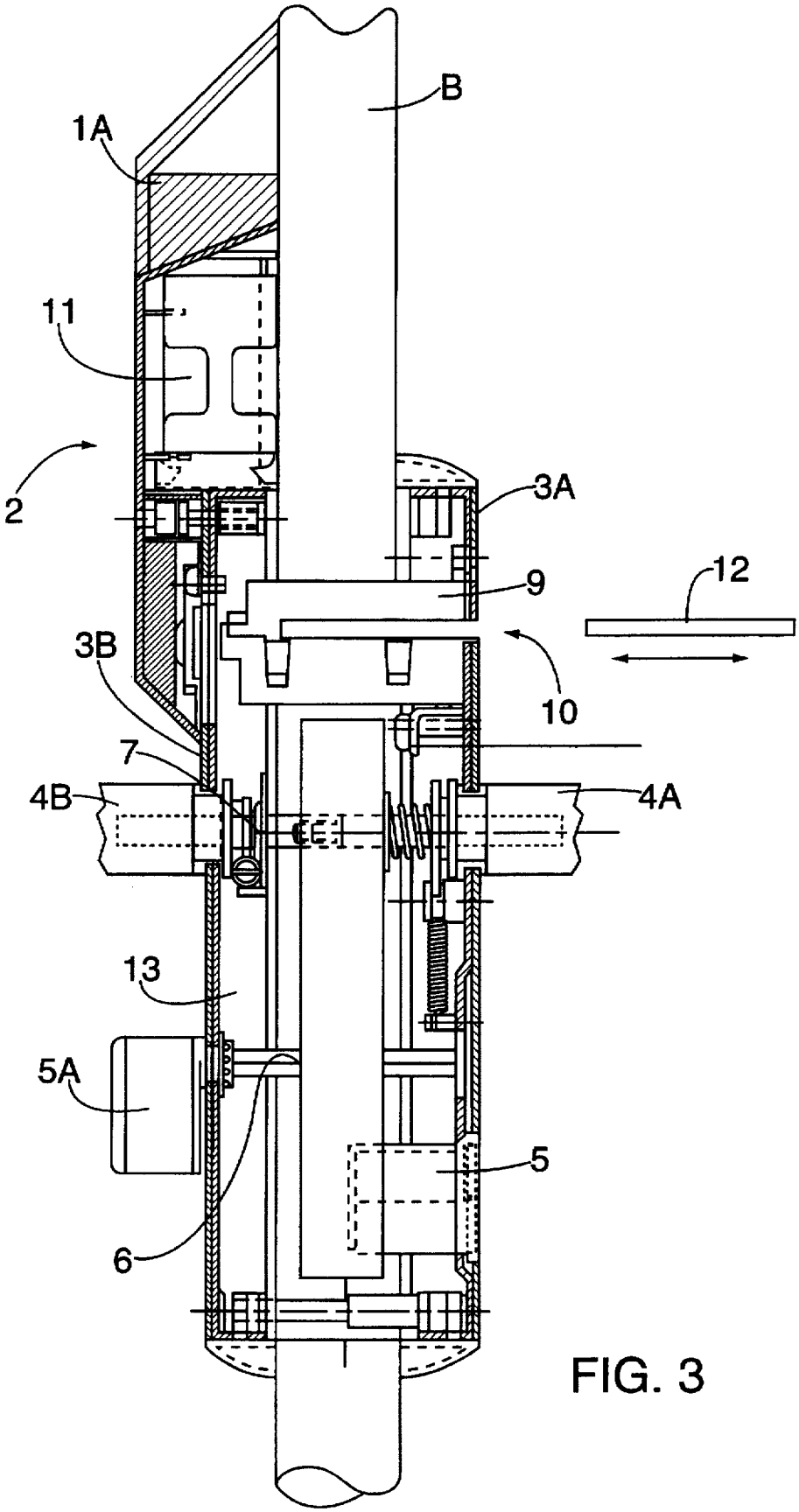
FIG. 3 shows schematically a vertical section through the front edge of a door provided with a lock according to the present invention, seen along line II—II on FIG. 2.

FIG. 3 shows an enlarged vertical section through a part of door B with lock 2, seen along line II—II of FIG. 2. The mechanical part of the lock may be of any conventional known type. According to the embodiment shown on FIG. 3, lock case 6 of the door comprises the various latches and dead bolt as well as the electrical and mechanical mechanism associated with the latches and dead bolt. Lock case 6 also houses an electric locking device which effects opening and closing of the door by means of the latches. These items are conventional to electronic locks. Door handles 4A and 4B are arranged on the external side and the internal side of the door, respectively, and are interconnected by means of pin 7. Pin 7 is locked by means of the electric locking device contained in lock case 6, such that when the door is locked, the actuating effect of handle 4A is suspended whereby rotation of handle 4A does not result in the opening of door B. The electric lock motor secures spindle 7 and blocks spindle 7 from rotating when lock 2 is in the locked mode. Lock 2 is intended to be operated by means of key card 12, containing a key code which is read by code reading unit 9 internally arranged in lock 2. Reader 9 is equipped with slot 10 having a shape and size which permit key card 12 to be inserted and allow the key card to be read by reader 9.

If key card 12 is inserted in lock 2 and contains a key code that matches an access code, an electric motor in mechanical part 6 will be actuated, releasing exterior door handle 4A so that door B, by turning exterior door handle 4A, may be opened. Current actuating the electric motor in lock case 6 is supplied from current source 11, such as a battery. The lock 2 is further equipped with a microcontroller 13, powered by current source 11. Microcontroller 13 is provided with a memory and a means for comparing the information which is read off of key card 12 and the information contained in the memory, i.e. access codes. These access codes may be loaded into the memory and stored in the memory or may be calculated by means of an algorithm by microcontroller 13. According to the present invention microcontroller 13 decides whether the electric motor housed in lock case 6 should be activated to allow door B to be opened, i.e. if the key code matches an access code. When a key member 12 is inserted into the opening 10, the reader 9 reads the key code of the key card 12. Also the reading unit 9 is powered by the battery 11. The battery 11 is preferably arranged on the interior side of the door.

The card reader 9 is equipped with a section which is intended to read the key code of the key card 12. Microcontroller 13 compares the key code from key card 12 with the access code and if the two match, then the electric motor in lock case 6 is activated to allow door B to be opened. If the key code and access code do not match, then the electric motor in lock case 6 is not activated and access to the room by door B is denied to the card user.

The detector is preferably a conventional motion detector. Typically, motion detectors use passive infrared technology (PIR); however, any conventional motion detector means can be employed in the present invention. The motion detector is preferably housed in the electronic lock itself and is part of the lock mounted on the inside of the door. Alternatively, the motion detector is mounted on an inside wall of the room. When the motion detector is not part of the lock itself, it has means to communicate with the lock and the lock with it.

The door switch detects when the door has changed state, i.e. opened or closed. The door switch sends a signal to said detector to turn on said detector such that each time the door changes state, said detector will operate to detect the presence or absence of a person in the room. If no person is detected in the room, then the block is turned off and the staff key will open the lock to allow hotel staff access to the room. This change of state occurs once when the door opens and once when the door closes. The door switch can communicate its change of state to the detector each time it changes state or only once, either when it opens or when it closes. Likewise, the detector can scan the room each time the door switch communicates a change of state or only once, either when the door is opened or when the door is closed.

The detector must scan the room long enough to obtain an accurate determination that the room is either occupied or not occupied. Scanning can start as soon as the door is opened, first change in state for the door switch, and not end until after the door closes, the second change in state for the door switch. Alternatively, the scanning continues for a preset period of time. In one preferred embodiment, a scanning sequence starts upon the first change of state of the door switch and continues for a preset period of time. In another preferred embodiment, a scanning sequence starts upon the second change in state of the door switch and continues for a preset period of time. In yet another preferred embodiment, a scanning sequence starts each time the door switch changes state and continues for a preset period of time. The scanning sequence is the same no matter whether a key opens the door or the door is opened from the inside of the room.

Figure 4:
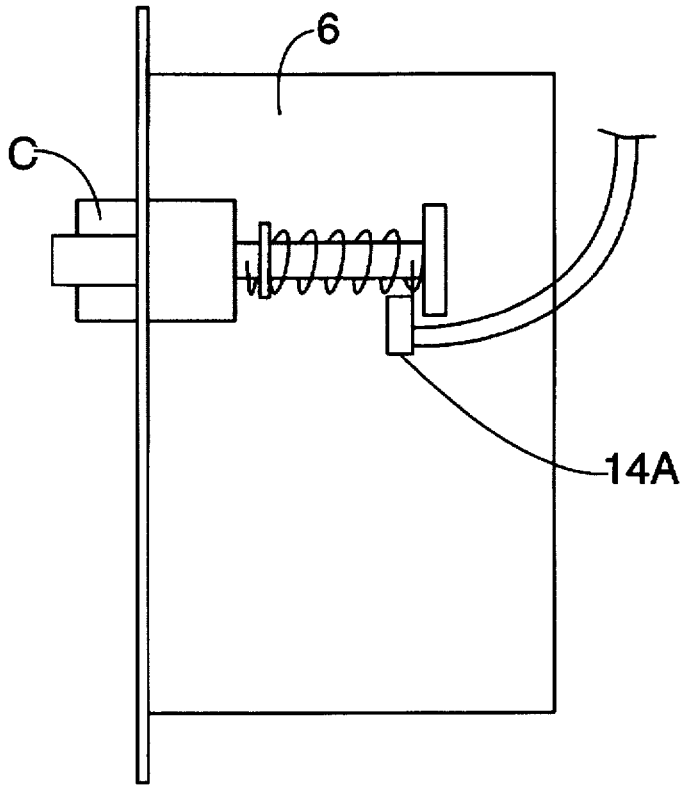
FIG. 4 shows schematically the inside of a lock case with a door switch.

Preferably, switch means 14A as shown in FIG. 4 is used in the present invention. Switch means 14A is located in lock case 6 and is connected to latch bolt C and activated by movement of latch bolt C. Switch 14A changes state each time door B is opened because of the movement of latch bolt C as it passes the door jamb. Switch 14A is located in lock 2 itself such that every time the door is opened from the inside by handle 4B, switch 14A is changed to tell microcontroller 13 to go through the process illustrated in FIG. 6. Alternatively, as shown in FIG. 2, switch 14B is located anywhere on the edge of door B such that when the door is separated from the door jamb, the pressure switch of switch 14B is released and the switch changes state. Preferably, switch 14B is wired to external device 15 that communicates the switch status to lock 2.

Lock 2 and, more specifically, microcontroller 13 is capable of allowing access to more than one card holder. For example, in a hotel situation, lock 2 will open not only for a guest but also for housekeeping, maintenance personnel and security personnel. Conventionally, such locks are referred to as having a hierarchy system and microcontroller 13 is able to compare key cards of the different cards and allow access simultaneously to these different personnel. In other words, a guest will hold a guest key card and the lock will provide access to the guest if the guest key card has a guest key code that matches a guest access code. Likewise, the lock will provide access to hotel staff with a staff key card if the staff key code matches the staff access code.

Heretofore, the only way for the guest to block access to hotel staff was by the deadbolt. With the present invention, lock 2 or, more specifically, microcontroller 13 after detecting use of a guest key card by the guest and a change in state of the door switch 14A or 14B, activates detector 1A or 1B to detect the presence of a person in the room. If a person (the guest) is detected in the room, then detector 1A or 1B communicates this to microcontroller 13 and microcontroller 13 instructs the electric motor in lock case 6 to deny access to staff key cards even though the staff key card has a staff key code that matches the staff access code and would open the door but for the presence of the person (guest) in the room.

Immediately preceding the use of a guest card key and every time thereafter, switch 14A or 14B will detect when door B has been opened, e.g. to allow entry of guest or for the guest to receive room service. Each time switch 14A or 14B detects the opening of door B, it sends a signal to microcontroller 13 which in turn sends a signal to detector 1A or 1B and instructs detector 1A or 1B to detect the presence of a person (the guest) in the room. If a person is detected in the room, microcontroller 13 continues the block. If no person is detected in the room, then the block is removed and hotel staff is allowed to enter the room. Following the use of a guest key card in the lock, the blocking of access to certain key cards will continue until no human is detected by detector 1A or 1B in the room after the door has been opened and closed. It should be appreciated that the use of a staff key card will not activate the blocking function of microcontroller 13. Detector 1B may be hard wired to lock 2 if it is mounted in door B or may communicate with lock 2 in a wireless manner such as by radio, light, sound, etc. in a manner similar to external device 15.

Preferably, microcontroller 13 is capable of accepting key cards besides just guest key cards when the block is on. In other words, it should block the staff key held by housekeeping and maintenance but not security, a security key card.

Figure 5:
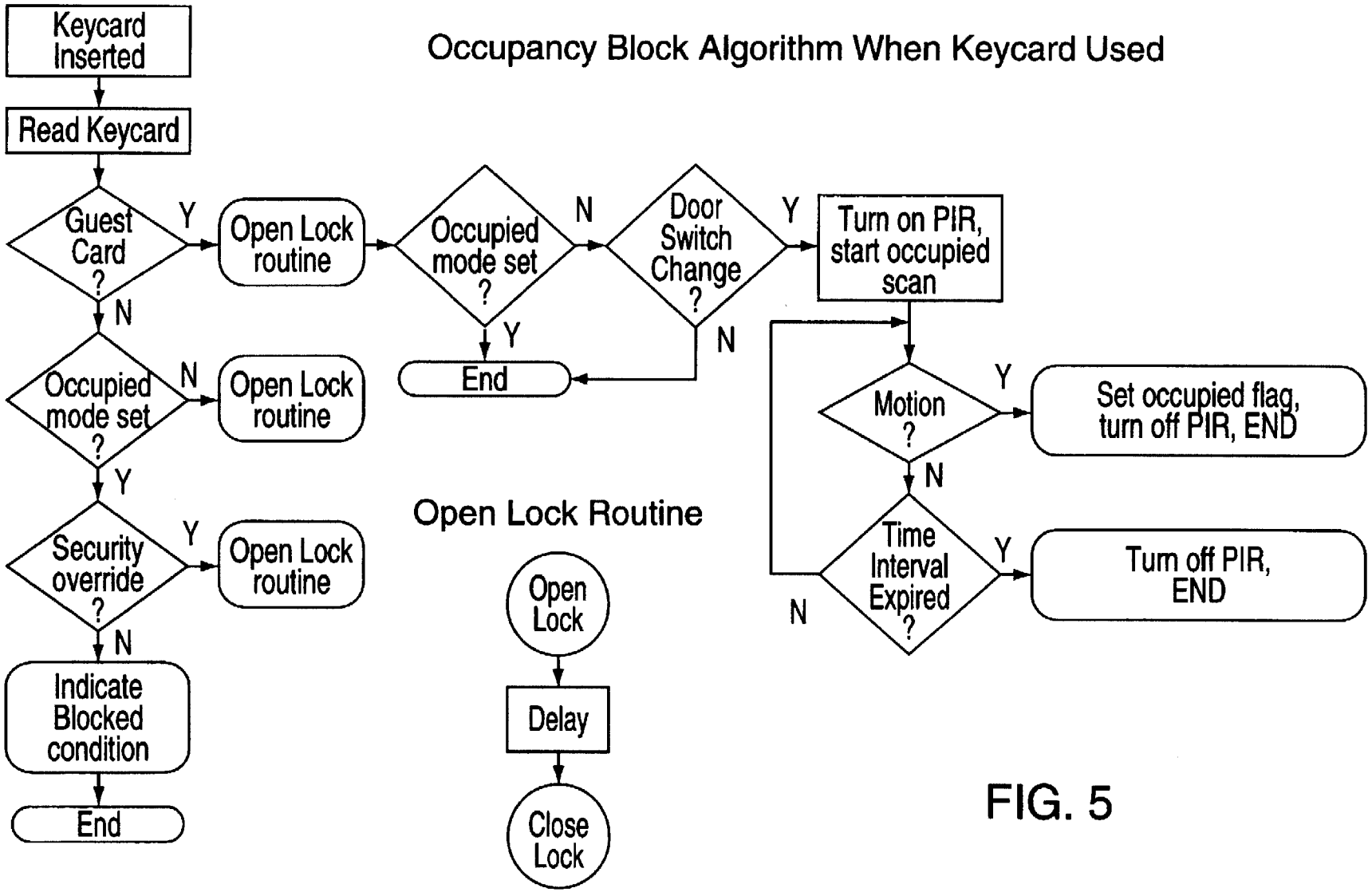
FIG. 5 is a flow diagram of the logic of the lock system after a key has been inserted.

FIG. 5 illustrates a flow diagram of the lock every time a card key is inserted into the lock. When the key card is inserted into the lock, the key code is read by the reader. If the key code matches a guest access code then the lock opens. If the key code does not match a guest access code, but does match a valid access code, say from housekeeping, then the microcontroller checks to see if the block is on. If the block is on, then the microcontroller checks to see if the key code matches an override access code, e.g. security. If the key code matches an override access code, then the lock opens. If the key code does not match the override code, then the lock remains in the locked state.

In FIG. 5 the block is referred to as the occupied flag or occupied mode and the motion detector is referred to as a PIR for passive infrared motion detector, the preferred motion detector.

Figure 6:
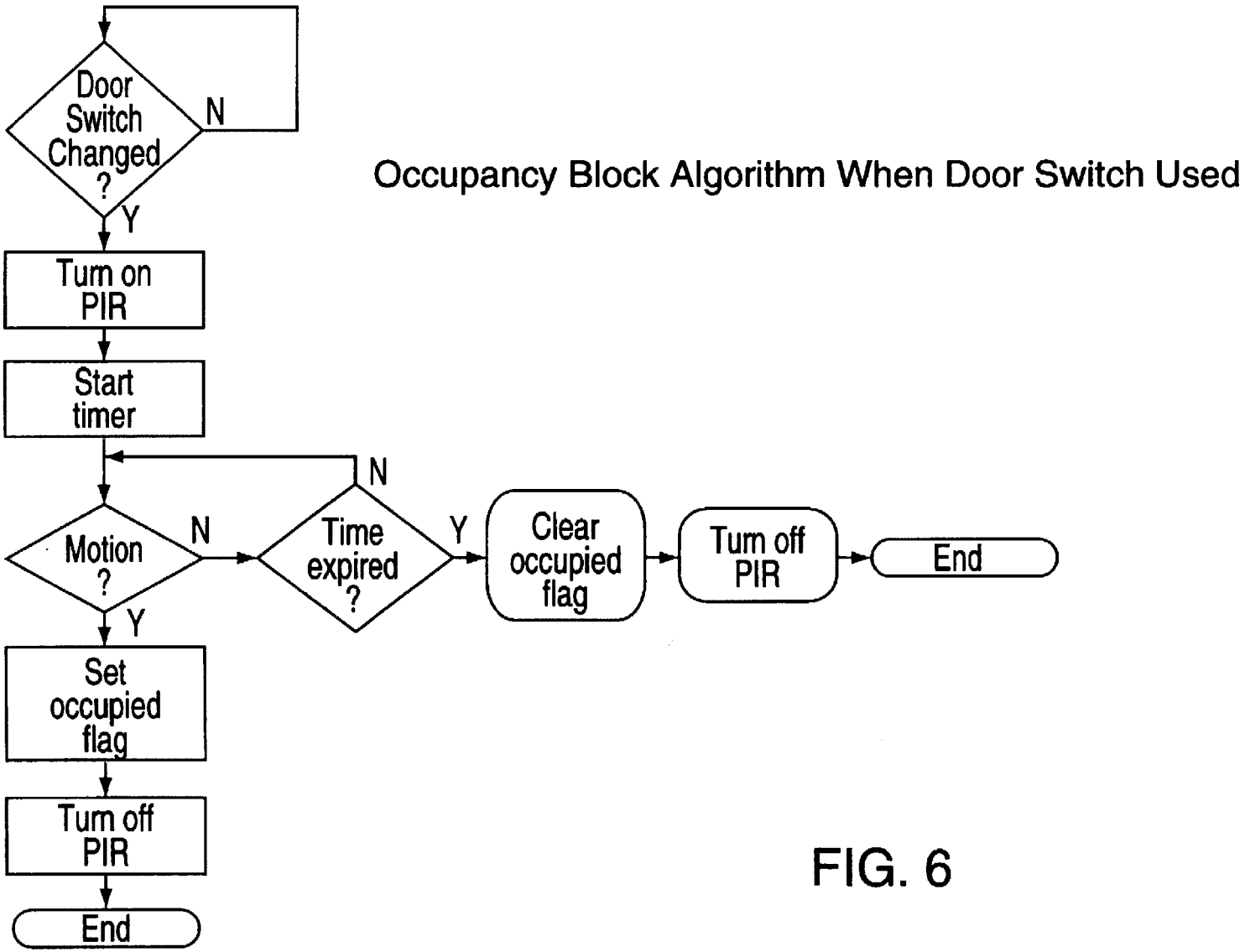
FIG. 6 is a flow diagram of one embodiment of the logic of the lock system after the door has been opened without the use of the key and the lock system of the present invention is equipped with a door switch.

FIG. 6 illustrates the flow diagram of the lock every time the door is opened. When the door switch changes state, the motion detector is turned on and it starts to scan the room for a set period of time to detect motion in the room. If no motion is detected, the block is cleared, the detector is turned off and the program ends. If motion is detected, then the block is continued or activated, the detector turned off and the program ends. As with FIG. 5, the block function is referred to as occupied flag or occupied mode and the motion detector is referred to as a PIR, passive infrared motion detector, the preferred motion detector.

Although the present invention has been described with reference to a hotel, it is equally applicable to ferries, cruise ships, railroad lines, as well as business offices and communal bathrooms. The present invention is applicable to any location where there is a user of a room and there is a desire to lock out or block the admission of other individuals while a user of the room is present in the room.

It will be understood that the claims are intended to cover all changes and modifications of the preferred embodiments of the invention herein chosen for the purpose of illustration which do not constitute a departure from the spirit and scope of the invention.

What is claimed is:

1. An electronic lock system having an electronic lock mounted in a door to allow access to a room wherein said lock can be opened by more than one key; and a key with a key code thereon; said lock having a means for reading said key code when a key is inserted into said electronic lock; a means for storing an access code; a means for comparing said key code with said access code such that if a key code matches said access code said lock opens to allow access to said room, the improvement comprising:

(a) a guest key with a guest key code thereon for use by a guest, said means for storing having a guest access code stored therein which matches said guest key code to allow access by said guest to said room;

(b) a staff key with a staff key code thereon for use by staff, said means for storing having a staff access code stored therein which matches said staff key code to allow access by said staff to said room;

(c) a means for detecting when a person is in said room; and (d) a means for blocking opening of said lock by said staff key when said guest key has been used succeeded by said means for detecting having detected a person in said room.

2. The electronic lock system of claim 1 wherein said means for blocking is housed in said electronic lock.

3. The electronic lock system of claim 1 further comprising a security key with a security key code thereon for use by security, said means for storing having a security access code that matches said security key code and allows access by said security to said room, and said means for blocking not preventing opening of said lock by said security key.

4. The electronic lock system of claim 1 wherein said means for detecting is a motion detector in combination with a door switch.

5. The electronic lock system of claim 4 wherein said motion detector is a passive infrared motion detector.

6. The electronic lock system of claim 4 wherein said motion detector is mounted on an inside wall of said room.

7. The electronic lock system of claim 4 wherein said motion detector is housed in said electronic lock.

8. A method for blocking access to a room by staff using an electronic lock mounted in a door for said room, comprising the steps of:

(a) blocking access to non-guest card keys after a guest card key has been used in said electronic lock and thereafter a person is detected in said room; and (b) removing said block to non-guest card keys by determining a change in state of said door and an absence of a person from said room.

* * * * *